US005996648A

United States Patent [19]

Himmelstoss

[11] Patent Number: 5,996,648

[45] Date of Patent: Dec. 7, 1999

[54] SELECTION DEVICE, THREE-POSITION WEAVING SYSTEM AND WEAVING LOOM EQUIPPED WITH SUCH A WEAVING SYSTEM

[75] Inventor: Michael Himmelstoss, Communay, France

[73] Assignee: Staubli Lyon, Chassieu, France

[21] Appl. No.: 09/127,832

[22] Filed: Aug. 3, 1998

[30] Foreign Application Priority Data

Sep. 1, 1997 [FR] France ..... 97 11031

[51] Int. Cl.[6] ..... D03C 3/12; D03C 3/20; D03C 3/06

[52] U.S. Cl. ..... 139/455; 139/65

[58] Field of Search ..... 139/455, 65; 335/219

[56] References Cited

U.S. PATENT DOCUMENTS 5,333,652 8/1994 Bassi et al. ..... 139/455
5,392,820 2/1995 Seiler ..... 139/455
5,671,784 9/1997 Dewispelaere .
5,881,777 3/1999 Bassi et al. ..... 139/455

FOREIGN PATENT DOCUMENTS 0723041 5/1984 European Pat. Off. .
0107099 7/1996 European Pat. Off. .

*Primary Examiner*—Andy Falik
*Attorney, Agent, or Firm*—Dowell & Dowell, P.C.

[57] ABSTRACT

A three position weaving system selection device which includes two superposed electromagnets each of which cooperates with a magnetic armature of one of a pair of pivoting levers so as to control the engagement of a projection of each lever with a movable hook of a pair of hooks which are normally displaced by a knife associated with a Jacquard harness.

15 Claims, 2 Drawing Sheets

SELECTION DEVICE, THREE-POSITION WEAVING SYSTEM AND WEAVING LOOM EQUIPPED WITH SUCH A WEAVING SYSTEM

BACKGROUND OF THE INVENTION

1. Field of the Invention

The present invention relates to a selection device, a three-position Jacquard loom weaving system and a weaving loom equipped with such a weaving system.

2. Brief Description of the Related Art

European Patent Application 0 723 041 discloses a three-position Jacquard system in which the mobile hooks associated with a funicular element determining the height of a heddle, may be selected thanks to two superposed electro-magnets. This device is complex and induces repeated deformations of the mobile hooks, which prevents their being given an adequate rigidity to guarantee a sufficient life duration for an industrial application and high-speed operation. In addition, the considerable deformations imposed on these hooks require powerful electro-magnets, with the result that the energy absorbed by the loom with which the know weaving system is associated, which include a large number of electro-magnets, is considerable.

It is an object of the invention to solve these problems by proposing a three-position weaving system selection device which is simple, therefore economical, capable of operating at high speeds and with low energy-consumption. Another object of the invention is to provide a selection device capable of operating with hooks able to be displaced in pairs.

SUMMARY OF THE INVENTION

To that end, the invention relates to a three-position weaving system selection device comprising two superposed electro-magnets adapted to be selectively activated, characterized in that it comprises at least one pair of pivoting levers disposed on the same side of the electro-magnets and each provided with a magnetic armature adapted to cooperate selectively with one of the electro-magnets, each lever being provided with a beak or projection for immobilizing a hook belonging to a pair of hooks capable of being displaced conjointly by a knife.

Thanks to the invention, each lever of a pair of levers may be controlled independently by one of the electro-magnets in order to immobilize, or not, a hook belonging to a pair of hooks. This makes it possible, as a function of the activation of the electro-magnets, to immobilize selectively one or the other of the hooks belonging to a pair, and even these two hooks at the same time, or neither of them. Pivoting of the two levers takes place without deformation thereof or of the mobile hooks that they allow to be selected, which avoids mechanical fatigue of these elements.

According to a first advantageous aspect of the invention, the beaks of the levers are adapted to be disposed on either side of the pair of hooks. Thanks to this aspect of the invention, the beaks clasp the two hooks belonging to a pair of hooks in the manner of pliers, which guarantees a particularly efficient immobilization of the hooks, including when the traction force exerted by the harness cords is considerable.

According to another advantageous aspect of the invention, the levers are articulated about pivot pins disposed, in a central zone, near the electro-magnets. This positioning of the pivot pins of the levers gives the device of the invention a good compactness, which is important when a large number of hooks must be controlled. This also makes it possible to produce, thanks to the two levers belonging to a pair, a gripping movement for immobilizing the hooks belonging to a pair of hooks.

According to another advantageous aspect of the invention, a first lever extends on either side of its pivot pin, the magnetic armature of this lever being carried by a first arm of the lever, while the beak of this lever is carried by a second arm of the lever. This geometry of the lever makes it possible, when its armature is disposed opposite the upper electro-magnet, to provide that the activation of this electro-magnet results in the moving away of or maintenance in remote position of the beak of the lever with respect to a median axis of the device. In that case, it may also be provided that a second lever extends overall in a single direction with respect to its pivot pin. When the second lever is disposed opposite a lower electro-magnet, the activation of the electro-magnet results in the approach of its beak, or in the maintenance of the beak in a position approaching the median axis of the device.

According to another advantageous aspect of the invention, the distance separating the beaks of the first and second levers is greater when at least one of the electro-magnets is activated than when neither of the electro-magnets is activated. The activation of the electro-magnet thus results in the opening of the pliers formed by the two levers or in the maintenance of such pliers in open position and, therefore, in the total or partial release of the pair of hooks capable of being immobilized because of these two levers.

According to another advantageous aspect of the invention, the device comprises means for elastically returning the levers in a direction of mutual approach of the beaks of the levers. These return means push the beaks of the levers towards a position of locking or of immobilization of the hooks of a pair of hooks.

According to another advantageous aspect of the invention, the hooks of the pair of hooks each include an orifice for receiving a beak of one of the levers, these orifices being disposed on either side of the pair of hooks. Each hook of the pair of hooks may thus be immobilized by one side of the pair of hooks, without interference with the other hook.

The invention also relates to a three-position Jacquard loom weaving system comprising a selection device as described hereinabove and to a weaving loom equipped with such a weaving system.

BRIEF DESCRIPTION OF THE DRAWINGS

The invention will be more readily understood on reading the following description of an embodiment of a three-position weaving system selection device in accordance with its principle, given solely by way of example and with reference to the accompanying drawings, in which.

DESCRIPTION OF PREFERRED EMBODIMENT

Figure 1:
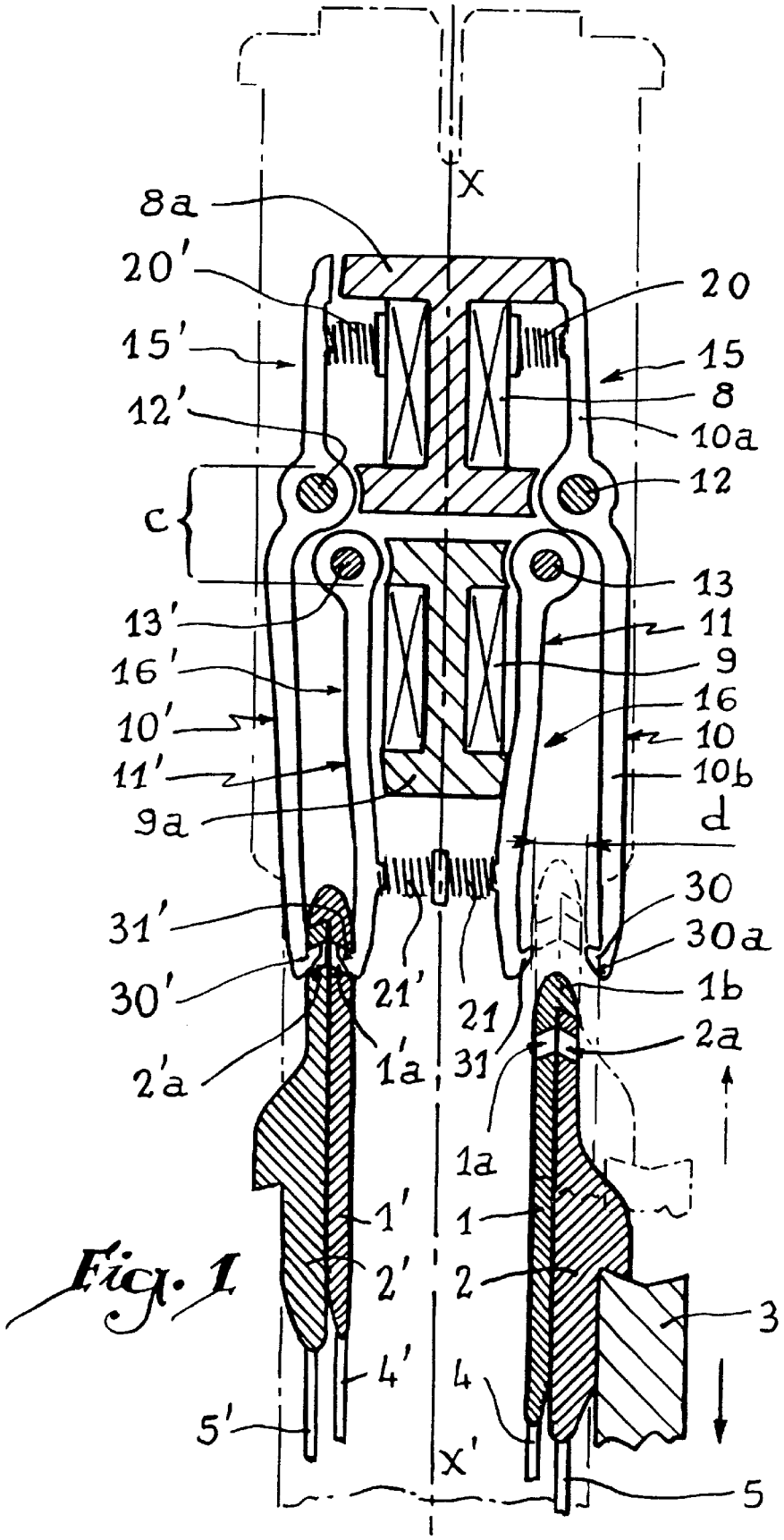
FIG. 1 is a view in longitudinal section of a selection device of a weaving system according to the invention in a first position.

Referring now to the drawings, the three-position weaving system selection device shown in FIG. 1 is intended to immobilize, in the vicinity of the top dead centre of their trajectory, two mobile hooks 1 and 2 or 1' and 2' adapted to be displaced conjointly in abutment on a knife 3 animated by a vertical reciprocating movement.

These mobile hooks 1 and 2 or 1' and 2' are respectively connected to a cord 4 and 5 or 4' and 5' constituting a funicular element for vertically displacing a pulley controlling the height of a heddle belonging to a Jacquard harness. These hooks function in pairs, in abutment on one another, in the manner described in Applicants' French Patent Application No. 96 12329. The system comprises two superposed electro-magnets 8 and 9 adapted to be selectively activated by means of a control module (not shown).

On either side of the electro-magnets 8 and 9 are disposed two pairs of levers 10 and 11, 10' and 11', respectively. Levers 10 and 10' are identical, as are levers 11 and 11'. Levers 10 and 11 are respectively articulated about pivot pins 12 and 13. In the same way, levers 10' and 11' are articulated about pins 12' and 13'. Lever 10 is provided with a magnetic armature 15 intended to cooperate with the core 8*a* of the electro-magnet 8 with a view to controlling pivoting of the lever 10 about the pin 12. In practice, the armature 15 is constituted by a first arm 10*a* of the lever 10 extending, from pin 12, in the direction opposite hooks 1 and 2. In the same way, lever 10' is equipped with an armature 15' intended to cooperate with the core 8*a*. The lever 11 also comprises an armature 16 constituted by a part of the lever 11 extending opposite the core 9*a* of the electro-magnet, this armature being intended to cooperate with the core 9*a*. An equivalent armature 16' is provided on the lever 11'. The armatures 16 and 16' are provided in the upper part of the levers 11 and 11'.

Return springs 20 and 21, 20' and 21' are respectively provided to permanently push the levers 10 and 11, 10' and 11', moving the armatures 15 and 16, 15' and 16' away from the cores 8*a* and 9*a* of the electro-magnets 8 and 9. The stiffness constant of the springs 20 and 21 and 20' and 21' is selected so that, when the armature of one of the levers is distant from the electro-magnet with which it must cooperate, the force generated by the activation of the electro-magnet is not sufficient to overcome the force due to the spring. On the other hand, when the armature of one of the levers is in abutment against the core of one of the electro-magnets, the magnetic force generated due to the activation of this electro-magnet is much greater than the preceding one, with the result that the electro-magnet may maintain the armature in abutment against the force of the return spring in question.

Each lever 10 and 11, 10' and 11' is provided with a beak or projection referenced 30, 31, 30' or 31' respectively. These beaks constitue the end of the levers 10, 11, 10' and 11' towards the hooks 1, 2, 1' and 2'. Beak 30 is carried by a second arm 10*b* of the lever 10 which extends in the direction of the pair of hooks 1, 2 from pin 12.

It will be noted that the pivot pins 12, 12' and 13, 13' lie in a central zone C of the device which comprises the lower part of the upper electro-magnet 8 and the upper part of the lower electro-magnet 9.

Taking into account the geometry and positioning of the levers 10 and 11, it will be understood that, when they are maintained applied between the cores 8*a* and 9*a*, their beaks 30 and 31 are maintained spaced apart, with the result that the pair of hooks 1 and 2 may descend in abutment on the knife 3 between these hooks from the top dead centre of its trajectory shown in dashed and dotted lines oil the right-hand side of FIG. 1. On the contrary, when the electro-magnets are not activated, the springs 20 and 21 push the levers 10 and 11, with the result that the beaks 30 and 31 tend to move close to each other. They may then penetrate in orifices 1*a* and 2*a* respectively provided in the upper part of the hooks 1 and 2, on either side of the pair of hooks.

When the beaks 30 and 31 are in place in the orifices 1*a* and 2*a*, the device is in the position shown on the left-hand side of FIG. 1, in which the beaks 30 and 31' penetrate respectively in orifices 1'*a* and 2'*a* of the hooks 1' and 2'.

It will be noted that the orifices 1*a*, 1'*a* and 2*a*, 2'*a* are inclined with respect to a median axis XX' of the device, which allows them to cooperate closely with tile shape of tile beaks 30, 30' and 31, 31'.

Figure 2:
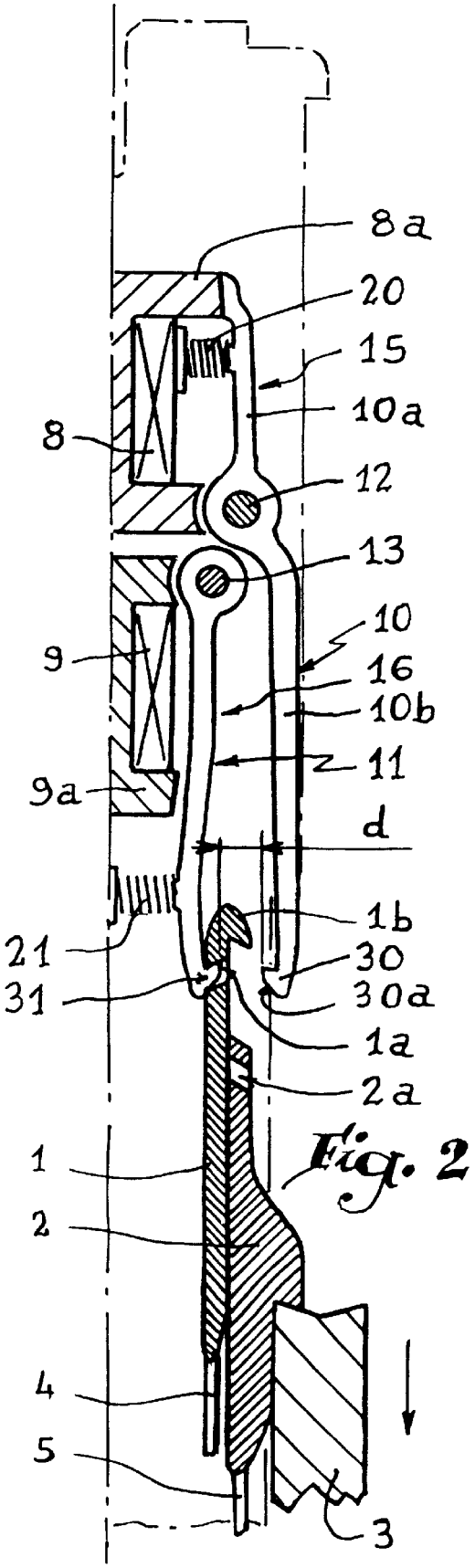
FIG. 2 is a partial view of the right-hand part of the device in FIG. 1 in a second position.
Figure 3:
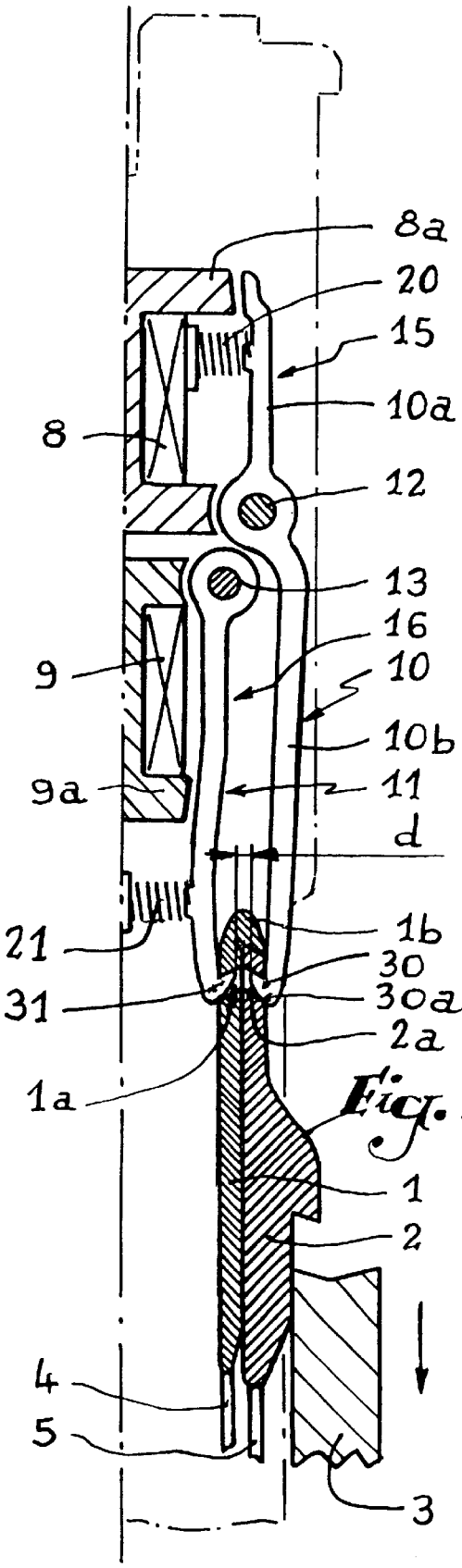
FIG. 3 is a view similar to FIG. 2, while the device is in a third position.

Operation of the device of the invention will be clearly apparent oil comparing FIGS. 1 to 3.

In rest position, the electro-magnets 8 and 9 are not activated, with the result that, under the effect of the return springs 20 and 21, the levers 10 and 11 are pushed in a direction of mutual approach of the beaks 30 and 31.

When the pair of hooks arrives near tile top dead center of its trajectory, the head 1*b* constituting the upper part of the hook 1 engages between the beaks 30 and 31 and separates them due to its tapered shape and the inclination of the beaks 30 and 31 on their outer faces. By moving apart the beaks 30 and 31, the head 1*b* pushes the armatures 15 and 16 of the levers 10 and 11 respectively in contact with the cores 8*a* and 9*a* of the electro-magnets 8 and 9.

In this position, the electro-magnets 8 and 9 may be activated or not. When the two electro-magnets 8 and 9 are activated, tile armatures 15 and 16 remain applied against the cores 8*a* and 9*a* against the force of the springs 20 and 21. The device is then in the position on the right-hand side of FIG. 1 in which the pair of hooks 1, 2 may, from its position of top dead centre represented in dashed and dotted lines, redescend in abutment on the knife 3.

When only electro-magnet 8 is activated, the armature 15 remains applied on the core 8*a* while lever 11 is pushed by spring 21. In this position, the beak 30 of lever 10 does not oppose the movement of descent of the hook 2 in abutment on the knife 3, while the beak 31 penetrates in the orifice 1*a* of the hook 1, with the result that the latter remains immobilized in the vicinity of the top dead center of its trajectory. The device is then in the position of FIG. 2.

When none of the electro-magnets is activated, the springs 20 and 21 respectively push the levers 10 and 11, with the result that the beaks 30 and 31 penetrate in the orifices 1*a* and 2*a* of the hooks 1 and 2 upon passage of these orifices opposite the beaks 30 and 31. The hooks 1 and 2 are then immobilized in the vicinity of the top dead center of their trajectory, as shown in FIG. 3. The hooks then remain in this position as long as the knife 3 does not, after an ascending movement, raise the hooks 1 and 2 so as to disengage them from the beaks 30 and 31, and the electro-magnets 8 or 9 are not activated.

Taking the foregoing into account, tile distance d separating the beaks 30 and 31 is variable as a function of the activation of the electro-magnets. As shown in FIGS. 1 to 3, this distance d is greater when at least one of the electro-magnets is activated (FIGS. 1 and 2) than when neither of them is activated (FIG. 3).

It will be noted that the geometry of the beak 30 which comprises an oblique front face 30*a* with respect to axis XX', enables it to cooperate with the head 1*b* of hook 1 in order to provoke a movement of retraction of the lever 10 at the approach of the pair of hooks 1, 2 in the vicinity of the top dead center of its trajectory. This aspect of the device of the invention makes it possible to provide that the elastic return force of the spring 20 is overcome mechanically thanks to the effort transmitted by the knife 3, the pair of hooks 1, 2 and the lever 10, while the electro-magnetic force serves only to maintain the lever 10 in the position of FIG. 1. The electro-magnets must therefore generate solely an electro-magnetic force for immobilization of the lever 10, this electro-magnetic force being much less than that which would be necessary for attracting such a lever from its remote position obtained under the effect of the return force due to spring 20.

In the same way, the geometry of the beak 31 likewise allows retraction of lever 11 and therefore the use of an electro-magnet 9 adapted to generate solely an electromagnetic force for immobilization of the lever 11 in position.

Consumption of electricity of a weaving system incorporating a large number of selection devices according to the invention is therefore not too great, insofar as the electro-magnets are dimensioned as a function of the criteria set forth hereinabove.

A three-position weaving system according to the invention of a weaving loom comprises a multiplicity of selection devices as described hereinabove and may operate with considerable reliability at high speeds, consuming little energy.

A weaving loom equipped with such a system thus makes it possible to obtain special fabrics such as velvets or carpets, at lower cost.

What is claimed is:

1. A three position weaving system selection device comprising; two superposed electromagnets adapted to be selectively activated, at least one pair of pivoting levers disposed on one side of said electromagnets and each of said pivoting levers provided with a magnetic armature adapted to cooperate selectively with a separate one of said electromagnets, each of said pivoting levers being provided with a projection adapted to selectively engage and retain a hook of a pair of hooks being displaced conjointly by a knife.

2. The selection device of claim 1, wherein said projections of said pivoting levers are adapted to be disposed on opposite sides of the pair of hooks and oriented in opposing relationship with respect to one another.

3. The selection device of claim 1, wherein said pivoting levers are articulated about pivot pins disposed in a zone intermediate said electro-magnets.

4. The selection device of claim 1, wherein a first of said pivoting levers includes a magnetic armature along a first arm thereof which extends on one side of a first pivot pin about which said first pivoting lever is mounted while said projection of said first pivoting lever is positioned on a second arm of said first pivoting lever which extends on an opposite side of said first pivot pin.

5. The selection device of claim 4, wherein a second of said pivoting levers is pivotally mounted about a second pivot pin, said second pivoting lever including a magnetic armature position along a portion thereof which is located on a same side of said second pivoting pin as said projection of said second pivoting lever.

6. The selection device of claim 5, wherein a variable distance separating said projections of said first and second pivoting levers is greater when at least one of said electromagnets is activated than when neither of said electromagnets is activated.

7. The selection device of claim 5, including elastic means for resiliently urging said projections of said first and second pivoting levers toward one another.

8. The selection device of claim 1, including elastic means for resiliently urging said projections of said first and second pivoting levers toward one another.

9. In a Jacquard harness having a heddle movable by funicular elements connected to at least one pair of hooks which are movable by a knife, the improvement comprising;

a three position selection device for controlling the movement of each hook of said pair of hooks, said three position weaving system including two superposed electromagnets adapted to be selectively activated, at least one pair of pivoting levers disposed on one side of said electromagnets and each provided with a magnetic armature adapted to cooperate selectively with a separate one of said electromagnets, and each of said pivoting levers being provided with a projection for selectively engaging and retaining a hook of the pair of hooks being displaced by the knife.

10. A weaving loom comprising;

at least one pair of movable hooks, each of which is connected to a funicular element adapted to control a heddle of a Jacquard harness, a knife for movably displacing said pair of hooks, a three position selection device for controlling the movement of each hook of said pair of hooks, said selection device including two vertically spaced electromagnets adapted to be selectively activated, at least one pair of pivoting levers disposed on a same side of said electromagnets, each of said pivoting levers including a magnetic armature adapted to cooperate selectively with a separate one of said electromagnets, and each of said pivoting hooks including a projection for selectively engaging and retaining a separate one of said hooks of said pair of hooks depending upon a relative position of said magnetic armatures of said hooks relative to said electromagnets.

11. The weaving loom of claim 10 in which said projections of said pivoting levers of each pair of pivoting levers are oriented toward one another, and resilient means for normally urging said magnetic armatures of said hooks in spaced relationship relative to said electromagnets.

12. The weaving loom of claim 11 in which a first of said pivoting levers is pivoted about a first pivot pin, said magnetic armature of said first pivoting lever being oriented on an opposite side of said first pivot pin from said projection of said first pivoting lever, and wherein a second of said pivoting levers is pivotable about a second pivot pin and said magnetic armature and said projection of said second pivoting lever being oriented on a same side of said second pivot pin.

13. The weaving loom of claim 12 where each of said hooks includes an orifice therein in which said projection of said pivoting levers are selectively received.

14. The weaving loom of claim 12 wherein said first and second pivot pins are positioned intermediate said two electromagnets.

15. A combination of a three position weaving system selection device and at least two hooks of a Jacquard harness, the combination comprising; two superposed electromagnets adapted to be selectively activated, at least one pair of pivoting levers disposed on a same side of said electromagnets and each provided with a magnet armature adapted to cooperate selectively with a separate one of said electromagnets, each of said pivoting levers being provided with a projection, a pair of hooks adapted to be displaceable by a knife, each of said hooks including an orifice for receiving said projection of one of said pivoting levers.

* * * * *